US008146525B2

(12) United States Patent
Lemminkainen

(10) Patent No.: US 8,146,525 B2
(45) Date of Patent: Apr. 3, 2012

(54) METHOD AND APPARATUS IN CONNECTION WITH THE SPINNAKER POLE OR SIMILAR OF A SAILING BOAT

(76) Inventor: Juho Lemminkainen, Helsinki (FI)

( * ) Notice: Subject to any disclaimer, the term of this patent is extended or adjusted under 35 U.S.C. 154(b) by 38 days.

(21) Appl. No.: 12/452,447

(22) PCT Filed: Jun. 26, 2008

(86) PCT No.: PCT/FI2008/050389

§ 371 (c)(1),
(2), (4) Date: Feb. 4, 2010

(87) PCT Pub. No.: WO2009/004113

PCT Pub. Date: Jan. 8, 2009

(65) Prior Publication Data

US 2010/0132604 A1 Jun. 3, 2010

(30) Foreign Application Priority Data

Jul. 4, 2007 (FI) ..... 20070524

(51) Int. Cl.
*B63H 9/10* (2006.01)

(52) U.S. Cl. ..... 114/102.28

(58) Field of Classification Search ..... 114/89, 114/97, 98, 39.21, 102.28
See application file for complete search history.

(56) References Cited

U.S. PATENT DOCUMENTS

| | | | | |
|---|---|---|---|---|
| 3,228,372 | A | 1/1966 | Ridder et al. | |
| 3,464,379 | A | 9/1969 | Lawson | |
| 5,558,035 | A | 9/1996 | Klein | |
| 6,425,338 | B1 * | 7/2002 | Stevenson, IV | 114/102.28 |

FOREIGN PATENT DOCUMENTS

| | | |
|---|---|---|
| DE | 8427267 | 1/1985 |
| DE | 29719160 U1 | 6/1998 |
| GB | 1035759 | 7/1966 |

* cited by examiner

*Primary Examiner* — Edwin Swinehart
(74) *Attorney, Agent, or Firm* — Skinner and Associates

(57) ABSTRACT

Method and apparatus in a system in connection with the spinnaker pole (8) or similar of a sailing boat, in which system a control line (12, 13) is attached to both guys (6, 7) of the sail (4). The control lines (12, 13) are arranged to run through the pole (8) and to move a piston (20) and the piston (20) is connected to means, with the aid of which the length of the pole (8) can be altered or the pole can be lowered to a lower position at its outer end. The piston (20) is preferably moved by the lines running around pulleys (23) and attached to the moving part (17) of the telescopic pole.

14 Claims, 5 Drawing Sheets

1
2
3
4
5
6
7
8

METHOD AND APPARATUS IN CONNECTION WITH THE SPINNAKER POLE OR SIMILAR OF A SAILING BOAT

The present invention relates to a method and apparatus in connection with the spinnaker pole or similar of a sailing boat.

In known fitting/pole assemblies, the pole and the pole-end fitting form a fixed totality. This property means that a gybe can generally be performed in two ways, both with their own difficulties and risks:

The 'end-to-end' method is characterized by the pole being detached from both the spinnaker sheet and the mast. The pole is carried through the fore triangle transversely to the direction of travel of the boat. The sheet on the other side is caught in the fitting that was recently attached to the mast while the other end is forced into an attachment with the mast. The term forced really describes the re-attachment of the pole to the mast: the length of the pole is generally the same as the J dimension of the boat. At the mast, on the other hand, half the width of the boat is generally less than half of the J dimension. This leads to a situation, in which, when the sheet seeks to be parallel to the centre line of the boat, a pressure transverse to the direction of the sheets acts on the pole, which hinders the attachment of the pole, especially in a strong wind. Sudden changes in the direction of travel of the boat result in changes in the direction and force of the wind, when the pole 'wrenches' in turn away from and towards the boat. This wrenching further hinders the completion of the maneuver.

A particular problem with the method is also its slowness: the gybe is performed when sailing straight before the wind, which slows the speed of the boat. The result is an increase in the relative wind speed, which increases the pressure on the sheets, further hindering the re-attachment of the pole to the mast.

This method is best suited to boats of less than 35 feet.

In a 'dipped gybe' two pairs of sheets are used at each corner of the sail, of which one pair is always without a load.

This method is characterized by the pole being kept attached to the mast. When the gybe starts, the topping lift is used to lower the pole sufficiently from the horizontal position to allow it to swing through the fore triangle. Once the pole has passed the forestay, a crewman at the bows attaches the lazy guy on the other side to the mounting. The method is best suited to boats of more than 35 feet, but demands more from the crew and the co-ordination of the crew, making it difficult in a heavy seaway. In addition, the method is famous for the loop in the lazy guy having to be placed in precisely the right direction, as otherwise a mess is created. When using this method, small knocks for the crew are usual, especially in an heavy seaway, when the man at the mast releases the pole in a uncontrolled manner to the one waiting at the narrowest part of the bows.

From the previously paragraphs it can be concluded that the problems relating to gybing are due to two basic reasons: either the detaching of the guy from the pole fitting, or the detaching of the pole from the mast.

The present invention is intended to eliminate these drawbacks and permit the spinnaker to be gybed in such a way that nothing is detached during the manoeuver and there is no need to go to risky places on deck.

The characteristic features of the invention are stated in the accompanying Claims.

Prior to a more detailed description of the invention, the advantages of the invention over the methods according to the prior art described above are stated in the following.

The method and device according to the invention make a spinnaker gybe easier, safer, and faster than other methods, especially for the reasons that:

- unlike a dipped gybe, there is no need to go to the narrowest part of the bows deck,
- unlike a dipped gybe, there is no need for two sets of sheets and guys,
- unlike a dipped gybe, it is not possible to mix the mutual order of the pair of guys,
- unlike a dipped gybe, there is no need to think about the direction of the loop in the new guy,
- unlike a dipped gybe, there is no need to beware of the pole being swung under the forestay, because a bows crewman is not needed,
- compared to the end-to-end method, safety is increased, because there is no need to stretch for the sheet outside and above the boat,
- unlike in the end-to-end method, the end of the pole is not detached from the mast, so that there is no need to re-attach it: in a strong wind and large waves this has been a major cause of physical injuries, such as abrasions, sprains, and blows,
- the speed of the method also increases safety; as changing the gybe is implemented rapidly, the speed of the boat remains high, i.e. the relative wind speed remains small, and thus the pressure acting on the sheet and the guy does not increase,
- because there is no need to go to the bows or the mast, the pitching of the boat is further reduced, which is advantageous, e.g., in a race. This is particularly the case in lightweight boat classes, in which the boat/crew weight ratio is small,
- rolling of the boat is attenuated, as unlike in traditional methods no-one is standing on the deck or mast performing the gybe. This affects the behaviour of the boat, especially rolling in a seaway. Again, this is particularly the case in sailing dinghy and light-displacement keeled boat and sailing-dinghy classes, in which the boat/crew weight ratio is small,
- the method according to the invention is also quick and easily to perform, which gives a tactical advantage in a race. The same reasons also make it desirable for cruisers.

Thus it can be generally stated that the present invention is, compared to the aforementioned methods, significantly more advanced, easier, safer, and faster.

The procedure according to the invention permits gybing in such a way that nothing is detached from the mast or the guy. Thus the pole carrier need not be lowered, because the new combination permits the pole to be swung through the fore triangle by loosening only one control line and pulling the other.

In the following, one well-regarded embodiment of the invention is described in greater detail, with reference to the accompanying drawings, in which:

In FIG. 1, the locations shown in the more important figures shown in the following are approximately marked by circled figure markings;

The method according to the invention will become apparent in connection with the accompanying description of the device.

Figures 1, 2, 3, 4:
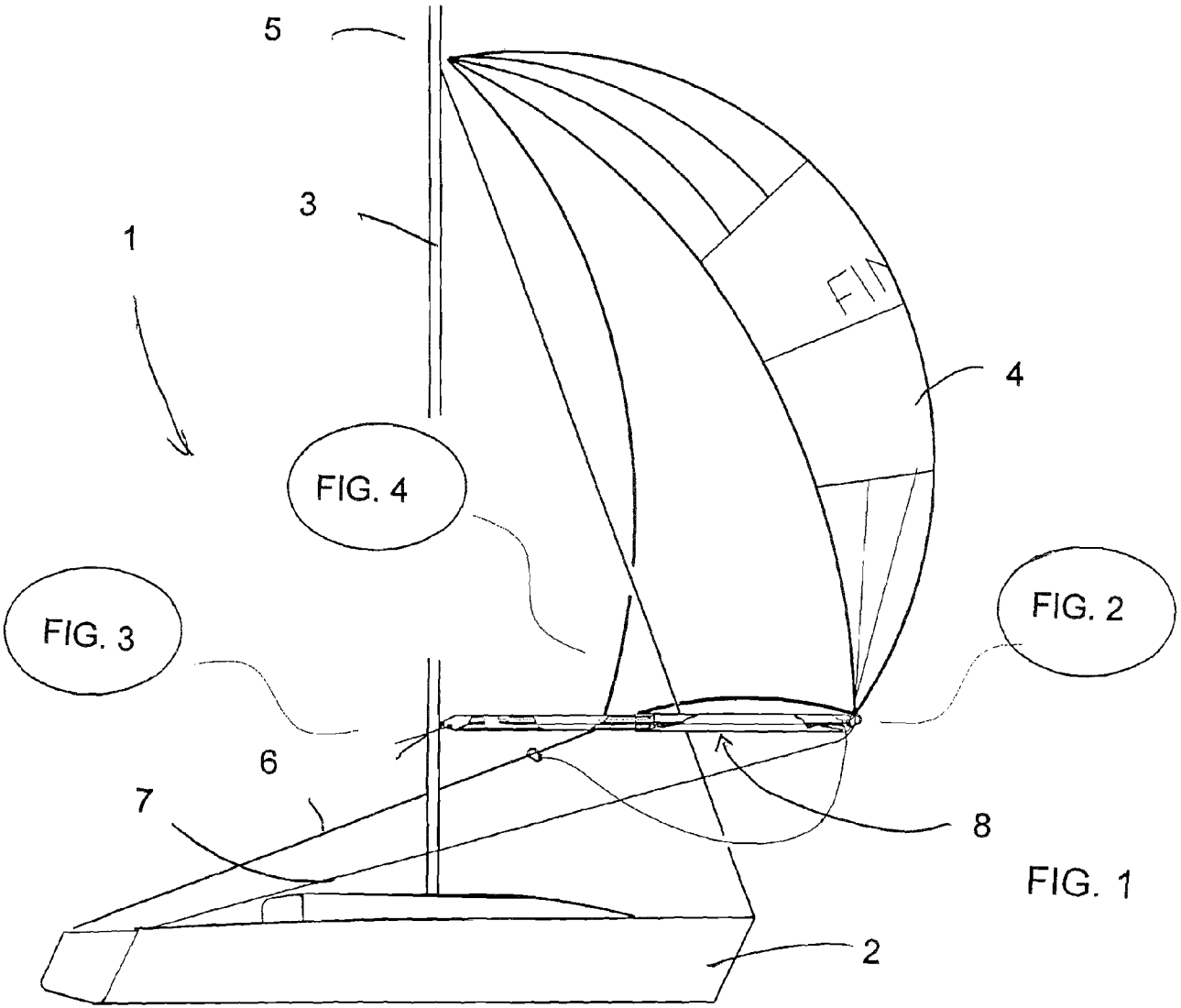
FIG. 1 shows a general view of a sailing boat, in which the method and device according to the invention are used.
FIG. 2 shows views in two different scales of the end of the pole according to the invention at the sail.
FIG. 3 shows in turn the part of the pole in the vicinity of the end of the pole at the mast.
FIG. 4 shows the telescopic plinerties of the pole according to the invention.
Figure 2:
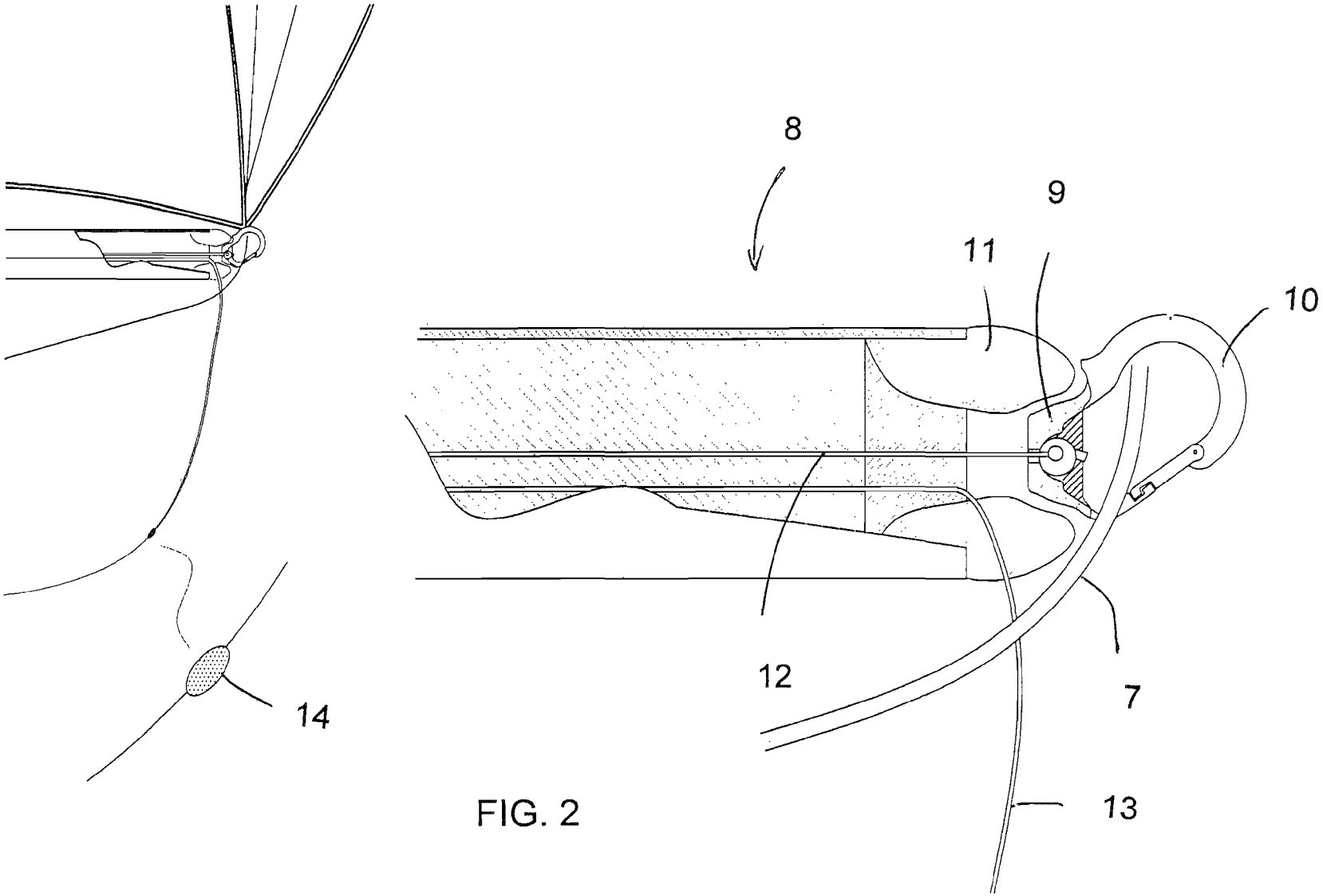
Figure 3:
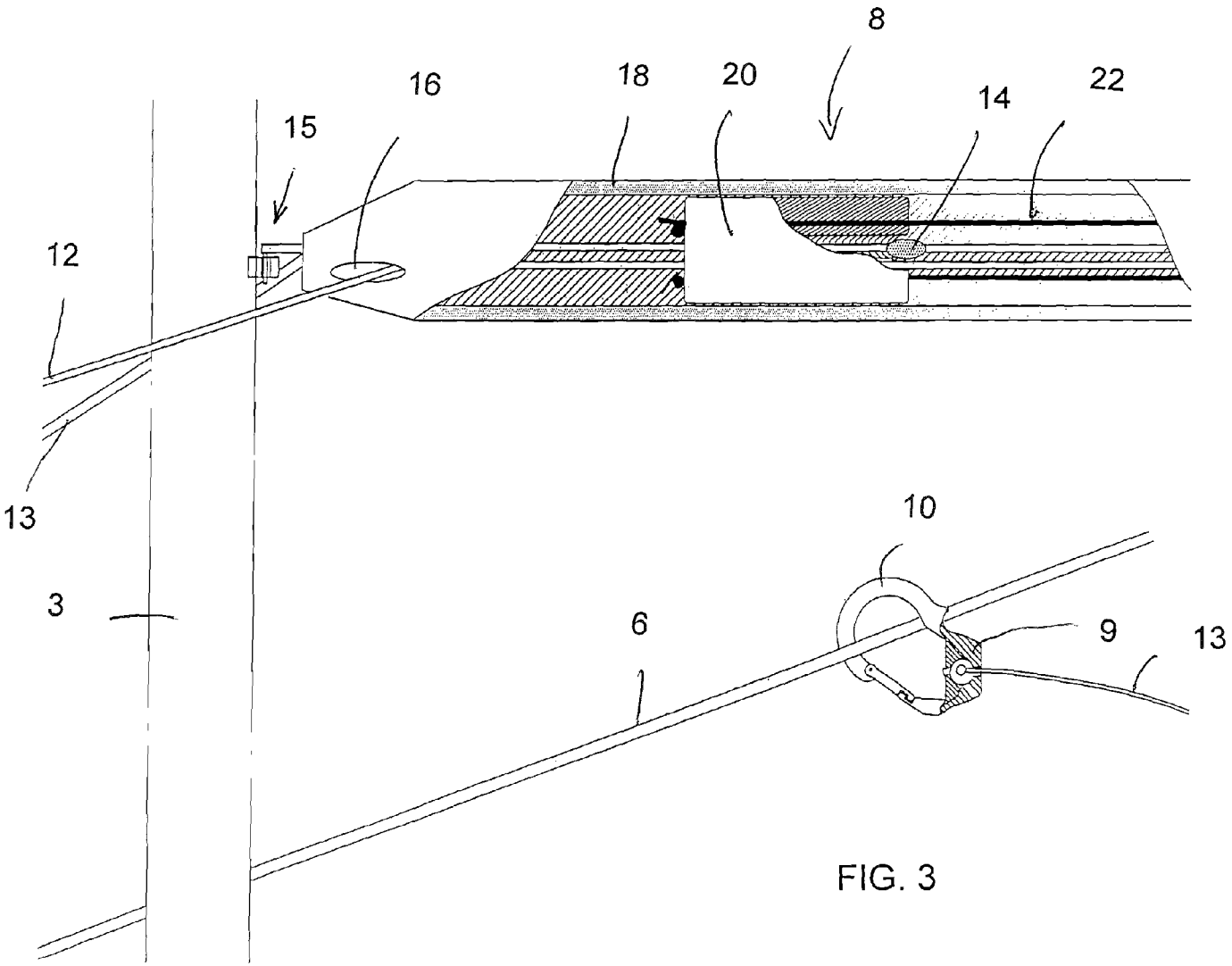
Figure 4:
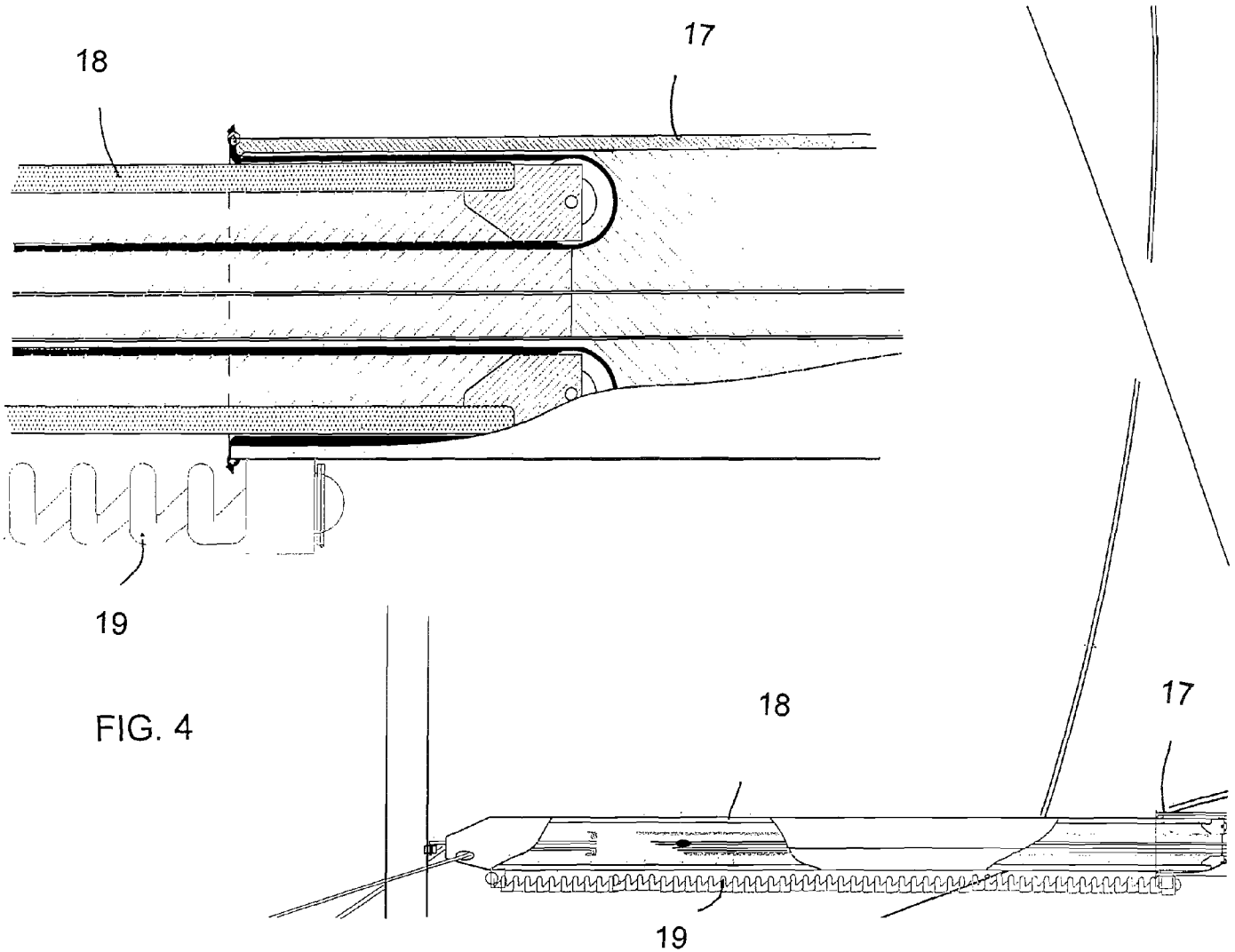

FIG. 1 shows a sailing boat 1, in which there is, in the conventional manner a hull 2, from the centre of which rises a mast 3. A spinnaker sail 4 is, in the conventional manner, attached to the upper part of the mast. The attachment point is marked schematically by the reference number 5. The corners of the sail 4 are equipped, in the conventional manner, with a sheet 6, which is thus attached to the left-hand (port side) corner and a guy 7 which is attached to the right-hand (starboard) corner of the sail, relative to the direction of travel of the boat. The sail forms a surface with the shape of ¼ of a sphere, attached at three points.

Irrespective of the wind direction, the pole 8 is attached at one end to the guy at the corner of the sail 4, and at the opposite end to the mast 3. In the manner described above, when the tack changes, the pole 8 must be changed from near to one lower corner of the sail 4 to near to the other lower corner. In the manner described in connection with the prior art the gybe is quite a problematic and risky operation. The particular reason for this is that a conventional pole is not suitable for swinging through the fore triangle of the boat if it is attached to the mast.

FIG. 2 shows the end of the pole 8 according to the invention, which is attached to the lower corner of the sail, i.e. its outer end. This end is on a part, which in the following is referred to as the satellite 9. In any event, the satellite 9 is a 'plug-like' component, in which there is a fitting 10, through which the guy 7 runs. A satellite 9, 10 of this kind is attached to both the sheet 6 and the guy 7. At the end of the pole there is a 'cup' 11, into which the satellite settles into place, no matter in what position it is when it approaches the cup 11. It should also be noted, as can be seen from the figure, that the fitting 10, which forms part of the satellite 9, can be opened, so that the satellite 9, and the fitting 10 with the control lines 12, 13 can be easily detached from the sheet when necessary.

It can also be seen from FIG. 2 that the control line 12 attached to the satellite 9 and fitting 10, runs freely through the pole. Similarly, it can be seen from the figure that the control line 13 running through the satellite attached to the sheet runs freely into and inside the pole.

In fact, both control lines 12 and 13 travel through the pole 8, to emerge in the immediate vicinity of its end next to the mast. The operation will be explained later. The smaller scale figure also shows the bead 14 attached to the control line, the purpose of which will also be explained later.

Next is described the end of the pole 8, next to the mast, shown roughly as a partial cross-section in FIG. 3. The attachment of the mast 3 and the pole 8 is taken care of in a suitable manner. A lug in the mast is marked schematically by the reference number 15, into the hole in which a pin in the end of the pole is set. Numerous different attachment methods are known. In any event, the attachment is conventional technology. The control lines 12 and 13 run inside the pole essentially from its outer end, through the opening in the piston 20, to the openings 16 in the inner end, where they become available for use by the sailor; control line 12 from the right-hand side of the pole profile relative to the direction of travel and control line 13, for its part, through the corresponding opening on the left-hand side relative to the direction of travel.

If the pole is set to the starboard side in the figure, the satellite 9, 10 visible in the lower part of FIG. 3 and its related control line 13 are freely attached to the sheet.

The pole 8 can be telescopically extended and shortened. FIG. 4 shows the outermost tubular part 17 and the innermost part inside it, which in the following is referred to as the body part 18. The body 18 is attached at its end to the mast 3 and the outermost tube to the guy near to the corner of the sail, with the aid of the satellite 9. It can be seen from the lower figure of FIG. 4 that the parts 17 and 18 are attached to each other by a spring 19, in such a way that, without a pull on the control lines 12 or 13, the pole 8 always retracts to its shortest possible length.

Figure 5:
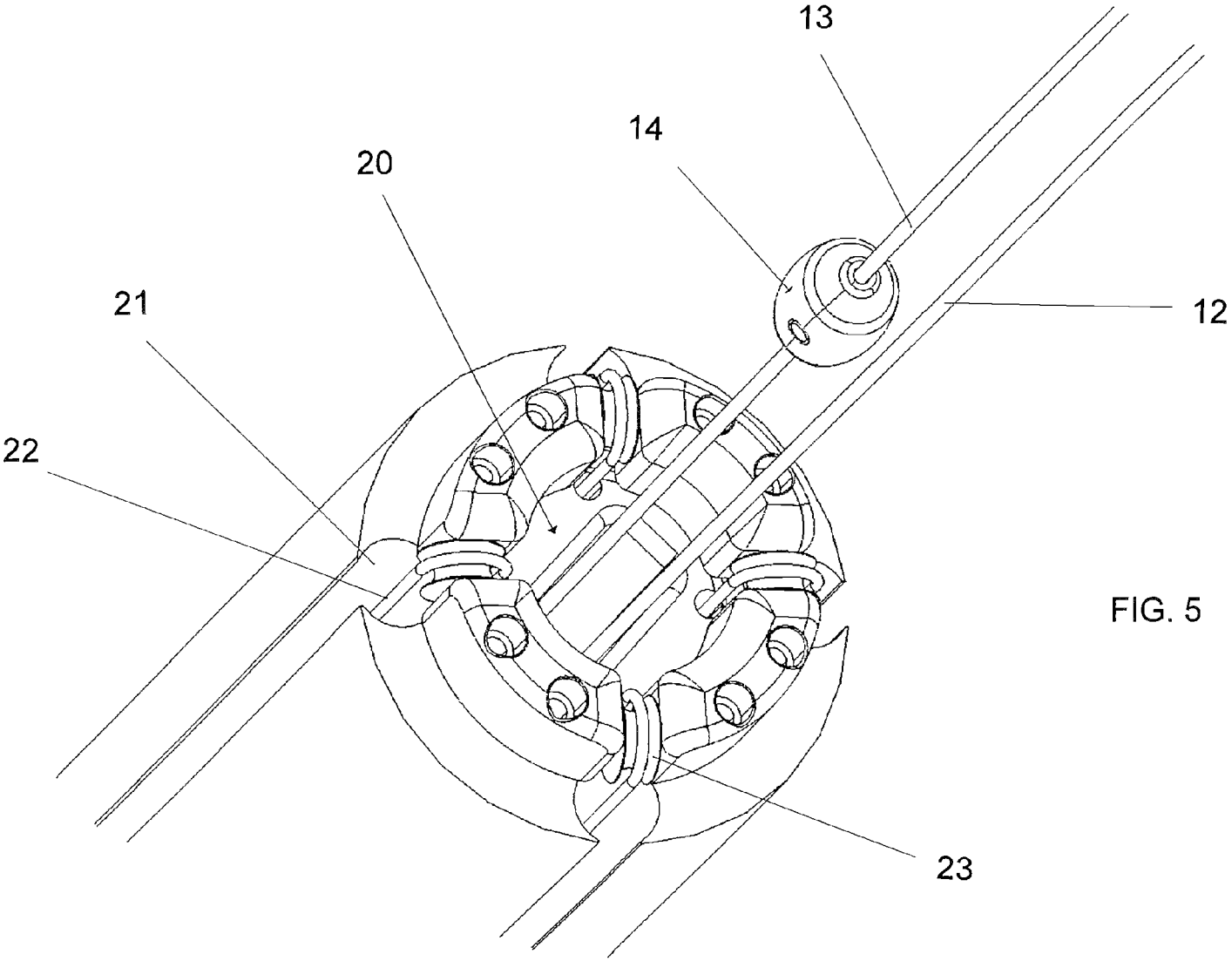
FIG. 5 shows details of the mechanism.

A piston 20, through a hole in the centre of which both of the control lines 12 and 13 run, moves inside the hollow core in the body part 18. Lines 22 are attached to the piston 20. The attachment is visible in FIG. 3. If the piston 20, the lines 22 also move with it. As can be seen from FIG. 5, the lines 22 run through the holes in the piston, then around the pulleys 23 and return in the direction from which they came, along grooves 21 in the outer surface of the body 18 and are attached at their other end to the edge of the outer tube.

A construction is thus formed in the manner described above, which operates in such a way that the movement of the piston 20 towards the mast lifts the outer tube 17 away from the mast. In other words, the pole lengthens. A suitable lifting ring can be fitted to the lower end of the tube 17 for attaching the lines 22.

How is this movement then created? On each control line 12, 13, the outer end, seen from the user, is attached to a satellite 9, 10, one line on the port side and the other on the starboard, is a bead 14. The bead 14 is suitably anchored immovably to the line.

When the sailor wishes to change gybe, he loosens the control line, which affects the side in question, when the force of the spring 19 causes the pole to retract, i.e. shorten. Next he begins to pull the control line on the other side, when the shortened pole begins to turn towards the other tack. In its shortened form, the pole fits easily through the fore triangle. Once the line has been pulled enough that the pole has moved essentially towards the new gybe, the bead 14 will come in contact with the piston 20. Because the bead will not fit through the opening in the piston, the user will at the same time begin, with the aid of the line/bead to move the outer tube 17 to the lengthened state of the pole through the lines 22 and pulleys 23, as a result of which movement the pole 8 will have moved to the correct position on the new gybe, where it is locked, since the control line is locked at the cockpit.

The lee-side control line 12 or 13 will be entirely free and loose, once the pole has been gybed to the windward side. All adjustment of the sail takes place using the sheet 6 and the guy 7, the control lines 12 and 13 being in a passive state; one locked, the other free.

Thus the gybe has been performed quickly, safely, and by a single operator.

Despite the new gybing method, the invention permits the spinnaker to be lowered and hoisted in the traditional, safe manner. It also permits the free movement of the unloaded control line, without affecting the trim of the sail.

The invention is also suitable for gybing asymmetrical spinnakers; both of the outermost pole-end fitting are attached to the tack ring of the sail, while the forestay remains inside the loop created. This permits the angle of attack of the pole, sail, and wind to be adjusted, so that more of the sail is available than when using a conventional bowsprit. And, of course, it also permits easy gybing.

The following presents the operation of the method and device according to the invention as a systematic description, without reference numbers.

In the initial situation, the satellites are attached to the spinnaker sheets. The pole is raised normally. At this stage, the pole is at its minimum length and will still fit through the fore triangle as required.

The gybe to be sailed is chosen and the control line on that side is pulled on. The pole now swings from the centre line of the boat to the chosen gybe and reaches its maximum length when the piston sinks to its lowest position. At the same time, the satellite meets the cup. The control line is locked at the cockpit.

The spinnaker sail is hoisted normally.

Sailing with the sail takes place normally, i.e. all adjustments of the trim of the sail take place using the guy, the sheet, and barberhaulers. The fitting/pole combination is in a passive state, and acts like a conventional pole.

At the start of a gybe, the loaded control line is released, when the bead detaches from the upper surface of the piston and allows the spring to operate. The spring now pulls the combination to its minimum length. The control line on the opposite side is pulled and the friction of the system, along with the position of the control-line exit holes in the conical part cause a pull downwards and above all to the side, towards the new gybe. The pole swings through the fore triangle—and due to the minimum length does not strike the forestay. The minimum length of the pole also causes the pole to drop slightly, which further assists the swing to the new gybe.

When the bead of the control line of the new gybe meets the upper surface of the piston, the processes begins from the start, but now on the new tack: the bead pushes the piston down, the pulleys turn the movement, and the pole moves in the opposite direction around the body. The cup and satellite meet, the control line is locked, and the combination reaches its maximum length.

The same procedure is repeated in connection with each gybe—quickly, easily, and safely.

When lowering the spinnaker, the procedure is the same as with a conventional pole: the windward guy is allowed to run through the satellite or the guy fitting is released.

The satellites can be detached from the sheet and the guy, but they can also be left attached for a new spinnaker leg. The pole is lowered into the place reserved for it.

The device according to the present invention can be relatively cheaply manufactured, either entirely by moulding from thermosetting plastic/thermoplastic/reinforced plastic, or by machining from metal. A desired combination of materials can also be used. All the lines used in the component are of Dyneema, which has excellent breaking strengths. Some of the lines are used unsheathed and impregnated, in order to reduce weight.

The entire combination described above can be adapted, with slight variations, to boats of different sizes:

Though what is described above is most suitable as a spinnaker fitting for 30-50-foot boats, the invention can also be applied to a somewhat lighter version, which is otherwise similar to that described above, but in which the telescopic feature is omitted by using a two-part tube. The pole does not then include an actual body part. A hole/pulley is made on the upper surface of the pole tube. The piston operates as above, but now, when it drops down it adjusts the line, which runs through the aforementioned hole to the topping lift, lifting the pole to the horizontal position. Correspondingly, when the satellite/bead/control line is released, the piston can rise to the upper position, and at the same time the line, which now runs from the piston through the hole/pulley in the upper surface of the pole, to the topping lift, loosens, and the end of the pole drops, allowing it to be swung through the fore triangle. The basic idea of this embodiment is very suitable for use in smaller boats, thus creating a special cheaper version for smaller boats. It is thus then possible to sell a package, in which the existing pole and its fitting at its mast end are exploited. Such a system is suitable for both sailing dinghies and keeled boats less than 30 feet long.

By slightly altering the shape of the satellite, the original idea can be applied to the gybing of large asymmetrical spinnakers. The difference is in the location of the pole closer to the deck level and the location of both satellites at the tack corner of the sail. Unlike known bowsprits, this pole can be used to adjust the angle of attack of the sail and the wind, i.e. bring it out, for example, so that the wind-direction vector forms a normal with the pole.

There is the fundamental advantage of the basic idea of the basic model: there is no need for anything to be detached during a gybe.

In the altered form, for lengthening/shortening the pole an embodiment can also be used, in which the original piston is replaced with a hollow rod, the outer surface of which has teeth transversely to its longitudinal axis, which by means of gear wheels can move the tube, with a grooved internal surface, in the opposite direction, according to the basic idea. Such a solution comes into question when forces increase and when the weight of the combination is not important. Such a 'robust' version is most suitable for really large world-cruiser class boats. The downside of this version is, of course, its price. The advantage is that it needs little maintenance, as in this model the lines can be omitted.

The invention is also characterized by being able to be used to increase the length of the pole by up to 1.6-1.8 times, without hindering gybing. This allows larger sails to be used, both symmetrical and asymmetrical. This an aspect that interests both racing and cruising sailors.

The invention claimed is:

1. A method of controlling a spinnaker pole (8) or similar of a sailing boat; in which a sheet (6) and a guy (7) are attachable to a spinnaker sail (4) and having a fore triangle, characterized in that control lines (12, 13) are arranged to travel through the spinnaker pole (8) and are arranged to move a piston (20) and that the piston (20) is connected to means to alter the length of the pole (8), or to lower the outer end of the pole, the method comprising the steps of choosing a first gybe to be sailed, actuating the control line (12 or 13) on the chosen gybe side, swinging the spinnaker pole to the chosen gybe side through the fore triangle and allowing the spinnaker pole to elongate or raise by movement of the piston, starting a second gybe by un-actuating the actuated control line (12 or 13) and actuating the opposing control line (12 or 13J permitting the piston to move and shorten or lower the spinnaker pole, and swinging the spinnaker pole to the second gybe side through the fore triangle.

2. Method according to claim 1, characterized in that the spinnaker pole (8) consists of first and second pole parts attached telescopically to each other and wherein the piston (20) is actuated by pulling the control lines (12, 13), in order to change the length of the pole.

3. Method according to claim 1, characterized in that the spinnaker pole is a one-part pole and wherein the piston (20) is actuated by pulling one end of a control line (12, 13), the other end of the control line (12, 13) being attached to a topping lift attached to the one-part pole, in order to lower/raise the end of the pole (8).

4. Method according to claim 2, characterized by the step of biasing the telescopic pole in a shortened state by a spring (19), for pulling the first and second pole parts (17, 19) together.

5. Method according to claim 1, characterized in that the control lines (12, 13) are equipped with a fixed stop (14), which when the control line is pulled presses against the piston (20) causing a movement in it in the direction of the pull and, with the aid of means attached to the piston, the shortening/lengthening of the pole, or the lowering/raising of its end.

6. A spinnaker control apparatus for a sailing boat, in which a sheet (6) and a guy (7) are attachable to a spinnaker sail (4), comprising a pole (8), a piston (20) movable inside the pole (8), control lines (12, 13) for attachment to the sheet and guy, and fixed stops (14) in control lines (12, 13) running through the piston, which move the piston (20) by pulling the control lines, and means attached to the spinnaker control apparatus for altering the length of the pole (8) or for lowering/raising its outermost end.

7. Apparatus according to claim 6, characterized in that the pole (8) consists of first and second pole parts (17, 18) attached telescopically to each other, and in that the means for altering the length of the pole comprise lines (22) that are attached at one end thereof to the piston (20) and at the other end thereof to the moving, first pole part (17) of the telescopic pole through pulleys (23).

8. Apparatus according to claim 6, characterized in that the means for lowering/raising comprises a line attached at one end thereof to the piston (20), and at the other end thereof to a topping lift attached to the pole for acting on the topping lift to lower or raise the pole.

9. Apparatus according to 7, characterized in that, a cup (11) is attached at the outermost end of the pole and a satellite and loop (9, 10) are attached to the control line (12, 13) the loop being attachable to both the guy and the sheet (6, 7) of the sail.

10. Apparatus according to 7, characterized in that the fixed stop (14) is a bead-like component permanently attached to the control line.

11. Apparatus according to 7, characterized in that the two telescoping pole parts (17, 18) are further connected to each other by a spring (19) for shortening the pole by the force of the spring in an unloaded state.

12. Apparatus according to claim 9, characterized in that the control lines (12, 13) run essentially through the entire length of the pole and through the piston (20) from the cup (11) to exit holes (16) located at the innermost end of the pole near the mast.

13. Apparatus according to claim 7, characterized in that on an outer surface of the second pole part (18) there are grooves (21) for the lines (22) to run from the pulleys (23) to the first pole part (17).

14. Apparatus according to claim 9, characterized in that the loop (10) can be opened, in order to detach the control lines (12, 13) from the sheet (6) and the guy (7).

* * * * *